US009757309B2

(12) United States Patent
Okutsu

(10) Patent No.: US 9,757,309 B2
(45) Date of Patent: Sep. 12, 2017

(54) MEDICATION-TAKING SUPPORT DEVICE

(71) Applicant: CLARION CO., LTD., Saitama (JP)

(72) Inventor: Kazuhiro Okutsu, Saitama (JP)

(73) Assignee: CLARION CO., LTD., Saitama-Shi, Saitama (JP)

( * ) Notice: Subject to any disclaimer, the term of this patent is extended or adjusted under 35 U.S.C. 154(b) by 0 days.

(21) Appl. No.: 15/036,976

(22) PCT Filed: Sep. 30, 2014

(86) PCT No.: PCT/JP2014/076038
§ 371 (c)(1),
(2) Date: May 16, 2016

(87) PCT Pub. No.: WO2015/076021
PCT Pub. Date: May 28, 2015

(65) Prior Publication Data

US 2016/0287479 A1 Oct. 6, 2016

(30) Foreign Application Priority Data

Nov. 19, 2013 (JP) ..... 2013-239206

(51) Int. Cl.
*G07F 11/00* (2006.01)
*A61J 7/00* (2006.01)
*A61J 7/04* (2006.01)

(52) U.S. Cl.
CPC ..... *A61J 7/0076* (2013.01); *A61J 7/0084* (2013.01); *A61J 7/0418* (2015.05); *A61J 7/0427* (2015.05);
(Continued)

(58) Field of Classification Search
CPC ..... A61J 7/0076; A61J 7/0427; A61J 7/04; A61J 7/0481; A61J 7/0084; A61J 2200/30; A61J 2205/20
(Continued)

(56) References Cited

U.S. PATENT DOCUMENTS 3,313,452 A * 4/1967 Katz ..... A47K 5/08 221/197
4,829,889 A * 5/1989 Takeuchi ..... A47J 31/0668 99/285
(Continued)

FOREIGN PATENT DOCUMENTS

JP H6-4758 A 1/1994
JP H9-253172 A 9/1997
(Continued)

OTHER PUBLICATIONS

International Search Report issued for corresponding PCT/JP2014/076038 application.
(Continued)

*Primary Examiner* — Rakesh Kumar
(74) *Attorney, Agent, or Firm* — IP Business Solutions, LLC

(57) ABSTRACT

A medication-taking support device that has no possibility of a pill case being left outside the medication-taking support device even if the pill case ejected outside a casing is not received by a user is provided. The medication-taking support device includes a cassette (25) that stores medicine-containing pill cases in such a manner that the pill cases are stacked on top of one another, a push-out mechanism (30) that pushes out the pill case on a lowermost tier in the cassette (25) by a predetermined dimension, and a pull-back
(Continued)

mechanism (32) that pulls back the pill case remaining on the lowermost tier without being extracted from the cassette (25) into the cassette (25).

9 Claims, 12 Drawing Sheets

(52) U.S. Cl.
CPC ..... *A61J 7/0481* (2013.01); *A61J 2200/30* (2013.01); *A61J 2205/20* (2013.01)

(58) Field of Classification Search
USPC ..... 221/7
See application file for complete search history.

(56) References Cited

U.S. PATENT DOCUMENTS 4,865,222 A * 9/1989 Sullivan ..... B65G 59/067 221/241
5,605,249 A * 2/1997 Gonyea ..... G07F 11/54 221/11
2015/0041355 A1* 2/2015 Lopez Losada .... G07F 17/0092 206/530

FOREIGN PATENT DOCUMENTS

| | | | |
|---|---|---|---|
| JP | H11-216171 A | | 8/1999 |
| JP | 2003-10288 A | | 1/2003 |
| JP | 2003010288 A | * | 1/2003 |
| JP | 2011031006 A | * | 8/2009 |
| JP | 2011-31006 A | | 2/2011 |

OTHER PUBLICATIONS

Written Opinion of the International Search Authority issued for corresponding PCT/JP2014/076038 application.
International Preliminary Report on Patentability issued for corresponding PCT/JP2014/076038 application.
Extended European Search Report dated Jun. 1, 2017 in the corresponding European Patent Application No. 14864340.6-1651.

* cited by examiner 27
32
36
30
36B
34
33
35
34A

MEDICATION-TAKING SUPPORT DEVICE

TECHNICAL FIELD

The present invention relates to a medication-taking support device, and particularly relates to a medication-taking support device including a cassette that stores medicine-containing pill cases.

BACKGROUND ART

There is generally proposed a medication-taking support device that stores a plurality of medicine-containing cases in the medication-taking support device, and includes a mechanism that ejects a medicine-containing case on a lowermost tier that is stored in the medication-taking support device to an outside of the device at a predetermined time (refer to Patent Literature 1). The conventional medication-taking support device of this kind includes a mechanism that automatically ejects a case containing a medicine that is to be taken at a predetermined time to the outside of the medication-taking support device when the predetermined time arrives, so that, for example, a person requiring long-term care or the like (hereinafter, referred to as a user) can easily take the medicine at a fixed time.

CITATION LIST

Patent Literature

Patent Literature 1: Japanese Patent Laid-Open No. 9-253172

SUMMARY OF INVENTION

Technical Problem

However, in the aforementioned conventional configuration, once the medicine-containing case is ejected to the outside of the medication-taking support device, the medicine-containing case is never returned to the inside of the medication-taking support device again. The medication-taking support device is on the precondition that the case containing the medicine to be taken at the time can be completely delivered to the user.

If the above described medicine-containing case is not received by the user, it is not preferable that the medicine-containing case is left outside the medication-taking support device as it is.

Thus, an object of the present invention is to provide a medication-taking support device that solves the problem of the aforementioned conventional art, and does not have a possibility of a medicine-containing case being left outside the medication-taking support device as it is, even if the medicine-containing case which is ejected to an outside of the medication-taking support device is not received by a user.

Solution to Problem

In order to attain the above described object, the present invention includes a cassette that stores medicine-containing pill cases in such a manner that the pill cases are stacked on top of one another, a push-out mechanism that pushes out a pill case on a lowermost tier in the cassette by a predetermined dimension, and a pull-back mechanism that pulls back the pill case remaining in the lowermost tier without being extracted from the cassette into the cassette.

In the present invention, the pull-back mechanism that pulls back the pill case which remains on the lowermost tier without being extracted from the cassette by the user into the cassette is included, and therefore, even if the pill case which is pushed out to an outside of the cassette by the push-out mechanism is not received by the user, the pill case is not left outside the medicine-taking support device.

The pull-back mechanism may be caused to act at a time of a retreating action of the push-out mechanism.

The pull-back mechanism may be integrated with the push-out mechanism.

In the invention, by integrating the pull-back mechanism and the push-out mechanism, the structure of the device can be simplified, and size reduction is achieved.

The pull-back mechanism includes a pull-back member that is fitted in a recessed portion of the pill case, and the pull-back member may be made escapable from the recessed portion of the pill case, when the push-out mechanism pushes out the pill case by the predetermined dimension.

The pull-back mechanism may include a cam member that causes the pull-back member to escape from the recessed portion.

In the invention as above, when the push-out mechanism pushes out the pill case by the predetermined dimension, the user takes hold of the tip end of the pill case which is pushed out by using his or her hand, and can extract the pill case from the medication-taking support device. The above described predetermined dimension is set at a dimension that allows the user to take hold of the pill case by using his or her hand.

In the present invention, when the pill case is pushed out by the predetermined dimension, the pull-back member escapes from the recessed portion of the pill case, and the user can extract the pill case to outside the medication-taking support device. When the pill case remains inside the medication-taking support device without being extracted to outside the medication-taking support device, the pull-back mechanism acts at the time of the retreating action of the push-out mechanism, for example.

That is, the pull-back member is fitted in the recessed portion of the pill case, and the pill case is pulled to the inside of the medication-taking support device.

Further, the push-out mechanism may be provided with a cassette detecting sensor and a pill case detecting sensor.

By providing the two sensors, a so-called empty cassette in which a pill case is not charged can be easily identified.

Further, the medication-taking support device of the present invention includes a door opening and closing detecting section that detects opening and closing of a door portion provided at an ejection port, a push-out mechanism position detecting section that detects an action position of the push-out mechanism, a pill case extraction determining section that determines whether or not the pill case is extracted on the basis of detection results of the door opening and closing detecting section and the push-out mechanism position detecting section, and a storage section that stores a determination result by the pill case extraction determining section.

According to the configuration of the present invention, the medication-taking support device can properly determine whether or not the pill case is extracted on the basis of the detection results of the door opening and closing detecting section, and the push-out mechanism position detecting section, the determination result is stored, and therefore, useful information on extraction of the pill case can be obtained on the basis of the stored information.

Further, in the medication-taking support device of the present invention, the pill case extraction determining section determines whether or not the pill case is extracted, when the door opening and closing detecting section detects that the door portion is closed.

According to the configuration of the present invention, the medication-taking support device can determine whether or not the pill case is extracted at a timing at which the door portion is closed by using the fact that the state of the door portion changes in accordance with presence or absence of extraction of the pill case.

Further, in the medication-taking support device of the present invention, the pill case extraction determining section determines that the pill case is extracted, when the extraction mechanism is determined as being located in a push-out completion position when the door portion is closed, and determines that the pill case is not extracted, when the push-out mechanism is determined as being not located in the push-out completion position when the door portion is closed.

According to the configuration of the present invention, the medication-taking support device can properly detect presence or absence of extraction of the pill case by using the characteristic in the structure of the device, an exclusive mechanism for detecting presence or absence of extraction of the pill case does not have to be provided in the device, and reduction of manufacture cost and size reduction can be realized.

Further, the medication-taking support device of the present invention includes a pill case extraction button that causes the pill case to be ejected, a pill case extraction determining section that determines whether or not the pill case is extracted, and a storage section that stores a determination result by the pill case extraction determining section, wherein the pill case extraction determining section determines that the pill case is not extracted, and stores the determination result in the storage section, when determining that the pill case extraction button is not operated within a predetermined time period set in advance, in which the pill case can be ejected.

According to the configuration of the present invention, the medication-taking support device can properly detect presence or absence of extraction of the pill case by using presence or absence of an operation of the pill case extraction button.

Advantageous Effect of Invention

According to the present invention, even if the pill case which is pushed out to the outside of the rack by the push-out mechanism is not received by the user, the pill case is pulled back to the inside of the rack by the pull-back mechanism, and therefore there is no possibility that the pill case is left outside the cassette.

DESCRIPTION OF EMBODIMENT

Hereinafter, one embodiment of the present invention will be described with reference to the drawings.

Figure 1:
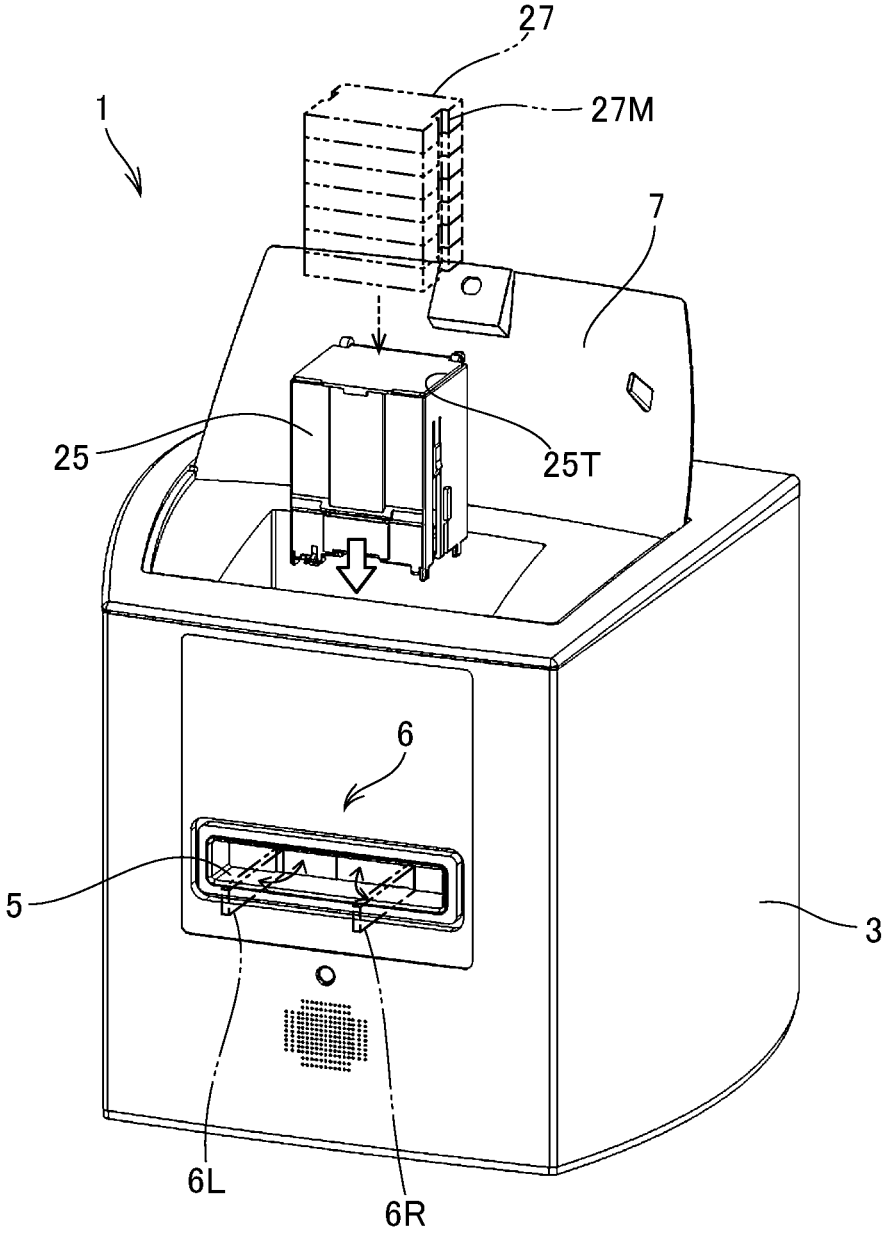
FIG. 1 is a perspective view of a medication-taking support device according to one embodiment of the present invention.

FIG. 1 is a perspective view of a medication-taking support device 1 according to the present embodiment.

In FIG. 1, reference sign 1 denotes the medication-taking support device 1. The medication-taking support device 1 is covered with a cover 3, and a pill case ejection port 5 (an ejection port) laterally longer is provided in a front face of the cover 3. An opening and closing lid 7 is provided on a top face of the cover 3. A double acting door 6 (a door portion) that closes the ejection port are provided at the pill case ejection port 5 to be openable and closable. The double acting door 6 will be described later.

Figure 2:
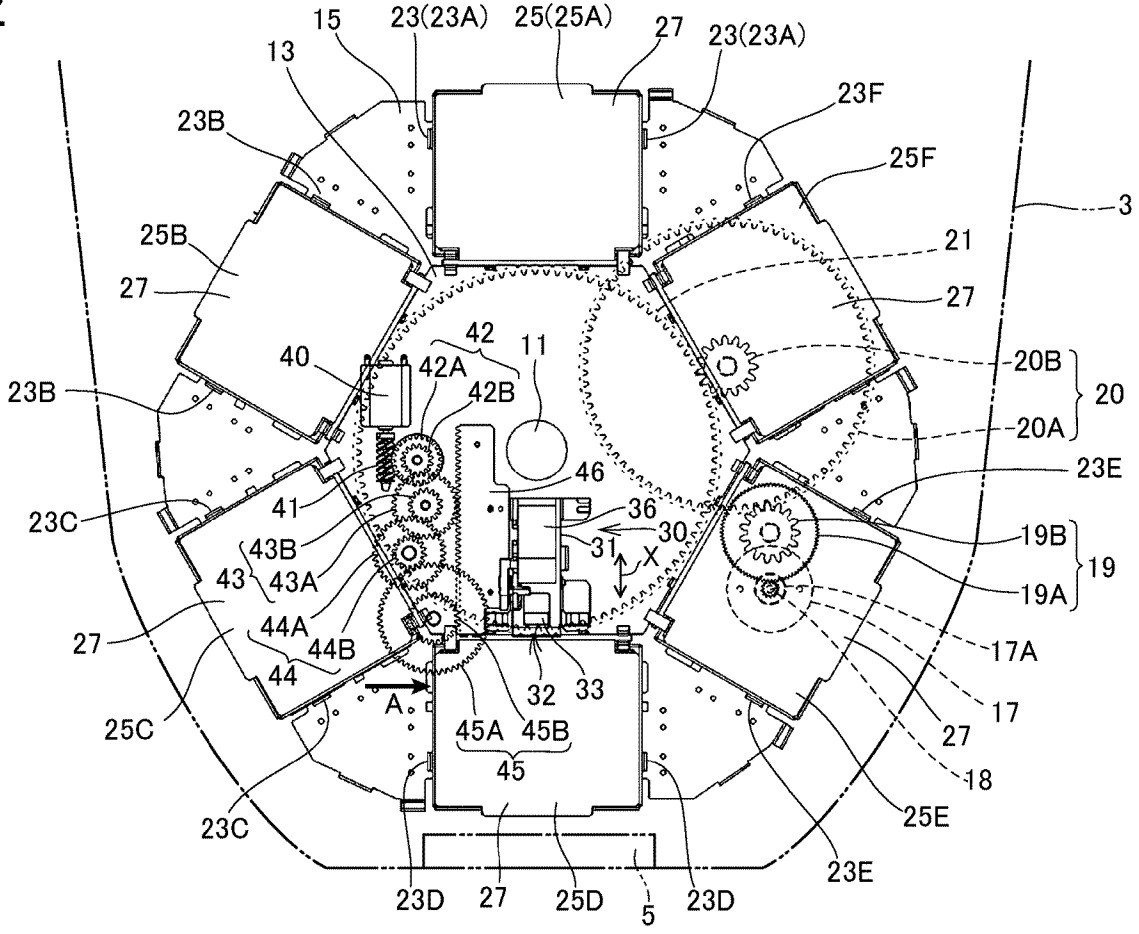
FIG. 2 is a plane view of an inside of the medication-taking support device.

FIG. 2 is a plane view of an inside of the medication-taking support device 1.

A rotary shaft 11 with an upper and a lower ends rotatably supported is disposed in a central portion inside the cover 3. A substantially hexagonal support plate 13 is integrally fixed to the rotary shaft 11, and a rotary basket 15 formed into a ring shape is fixed to the support plate 13.

The rotary basket 15 is rotationally driven by a motor 17. A gear 18 is fixed to an output shaft 17A of the motor 17. The gear 18 is meshed with a gear 19A of an integral gear 19. A gear 20A of an integral gear 20 is meshed with a gear 19B of the integral gear 19. A large gear 21 is meshed with a gear 20B of the integral gear 20, and the large gear 21 is connected to the rotary shaft 11. Consequently, when the motor 17 is rotationally driven, the large gear 21 rotates via the gear 18, the integral gear 19 and the integral gear 20, the rotary shaft 11 rotates integrally with the large gear 21, and the rotary basket 15 rotates integrally with the rotary shaft 11 via the support plate 13.

In the rotary basket 15, six racks 23 (23A to 23F) are disposed equidistantly in a circumferential direction. The respective racks 23 (23A to 23F) have upper sides opened, and from the openings at upper sides, cassettes 25 (25A to 25F) are respectively attached. Seven pill cases 27 (refer to FIG. 1) are stored in each of the cassettes 25 (25A to 25F), and in each of the pill cases 27, a medicine not illustrated is stored.

In the medication-taking support device 1, medicines for seven days are managed for one user. At a predetermined time of day, the pill case 27 on a lowermost tier, which is stored in the cassette 25D, for example, is pushed out from the pill case ejection port 5 (refer to FIG. 1). The user extracts the pill case 27 which is pushed out with his or her hand, and takes the medicine. At a next time of day, the pill case 27 stored in the cassette 25E, for example, is pushed out from the pill case ejection port 5.

The user extracts the pill case with his or her hand, and takes the medicine. The user repeats taking the medication, and can take medicines to be taken at set times, six times a day.

Further, though not illustrated, a pill case extraction button may be provided in the device, the user may be informed that the time for medication arrives by voice or vibration when the predetermined time arrives, a push-out mechanism may be caused to act when it is determined that the pill case extraction button is pressed by the user, and the pill case 27 on the lowermost tier, which is stored in the cassette 25D may be pushed out from the pill case ejection port 5 (refer to FIG. 1).

In the above described configuration, in the cassette 25, the seven pill cases 27 containing medicines to be taken at the set time of day, as the medicines for seven days (refer to FIG. 1) are stored.

In this case, six different kinds of colors are applied to the cassettes 25. Coating of a same kind of color is applied to the pill cases 27 corresponding to each of the cassettes 25, and by the coating of colors, erroneous disposition of the pill cases 27 of the medicines to be taken at the set times is prevented.

Further, as shown in FIG. 1, a protrusion 25T is provided on a side face of the cassette 25, and grooves M in which the protrusion 25T is fitted are provided at the corresponding pill cases 27. Locations of the protrusions 25T differ according to the cassettes 25, and locations of the grooves M differ according to the pill cases 27, whereby erroneous disposition of the pill cases 27 is prevented.

Next, a push-out mechanism for the pill case 27 will be described.

As shown in FIG. 2, in the embodiment, a push-out mechanism 30 is fixedly disposed to face the pill case ejection port 5.

The push-out mechanism 30 includes a push-out block 31, and the push-out block 31 reciprocates in a direction of an arrow X with an illustrated position as a standby position.

That is, the push-out block 31 is reciprocated by a motor 40. A gear 41 is fixed to an output shaft of the motor 40. The gear 41 is meshed with a gear 42A of an integral gear 42, a gear 43A of an integral gear 43 is meshed with a gear 42B of the integral gear 42. A gear 43B of the integral gear 43 is meshed with a gear 44A of an integral gear 44, a gear 45A of an integral gear 45 is meshed with a gear 44B of the integral gear 44. A gear 45B of the integral gear 45 is meshed with a rack gear 46, and the rack gear 46 is connected to the push-out block 31.

Accordingly, when the motor 40 is rotationally driven, a speed is reduced via the gear 41, and the integral gears 42, 43, 44 and 45, and the rack gear 46 reciprocates in the direction of the arrow X, and the push-out block 31 reciprocates in the direction of the arrow X integrally with the rack gear 46.

Figure 3:
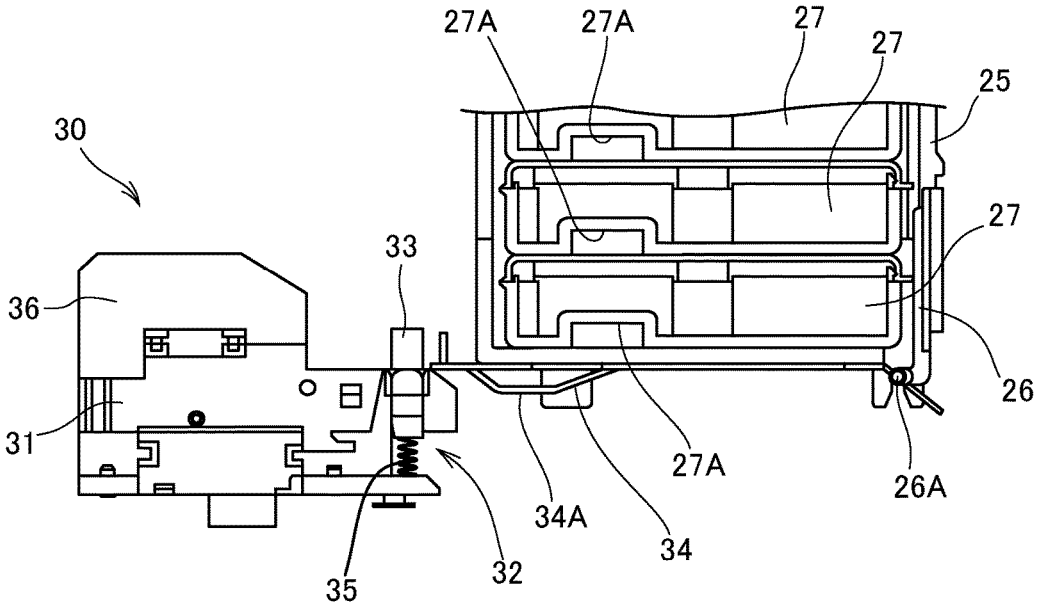
FIG. 3 is a side view showing a push-out mechanism in a standby position.

FIG. 3 is a view seen along an arrow A in FIG. 2, and shows the push-out mechanism 30 in the standby position. The push-out mechanism 30 includes a pull-back mechanism 32.

The pull-back mechanism 32 includes a pill case returning claw (pull-back member) 33 disposed in the push-out block 31, and a plate-shaped cam (a cam member) 34 disposed on an undersurface of the rack 23. The pill case returning claw 33 is urged upward by a spring 35. A pill case support portion 36 is provided at the push-out block 31 of the push-out mechanism 30.

Next, with reference to FIG. 4, a process of the push-out mechanism 30 pushing out the pill case 27 on the lowermost tier, which is charged in the cassette 25 will be described.

Figure 4A:
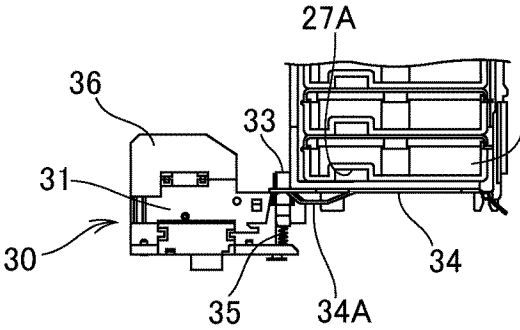
FIG. 4 A to F are views explaining a push-out action by the push-out mechanism.
Figure 4B:
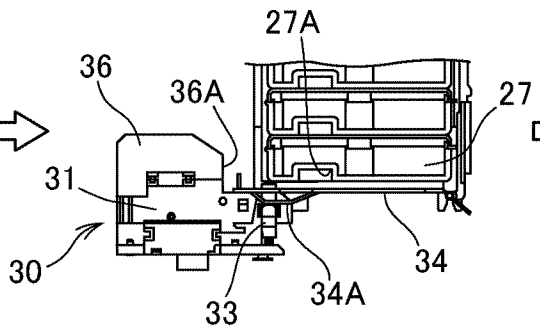
Figure 4C:
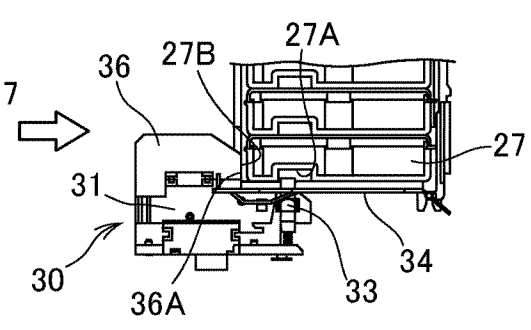

As shown in FIG. 4A and FIG. 4B, when the push-out mechanism 30 moves forward, the pill case returning claw 33 of the pull-back mechanism 32 lowers along a convex face 34A of the cam 34, against a spring force of the spring 35. When the push-out mechanism 30 further moves forward, the push-out mechanism 30 reaches a position in FIG. 4C, and the pill case returning claw 33 rides over the convex face 34A of the cam 34 to protrude upward by the urging force of the spring 35, and enters a recessed portion 27A on the undersurface of the pill case 27. In the present embodiment, the recessed portion 27A is formed on the undersurface of the pill case 27.

Figure 4D:
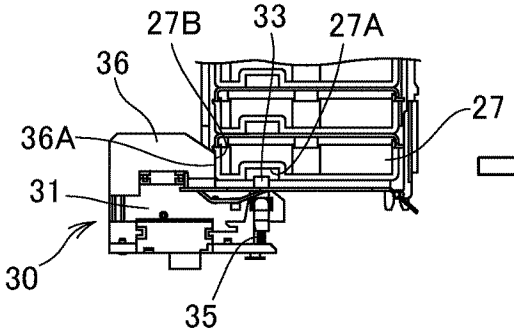

When the push-out mechanism 30 further moves forward, the push-out mechanism 30 reaches a position in FIG. 4D, and a tip end 36A of the pill case support portion 36 abuts on a rear end 27B of the pill case 27.

Figure 4E:
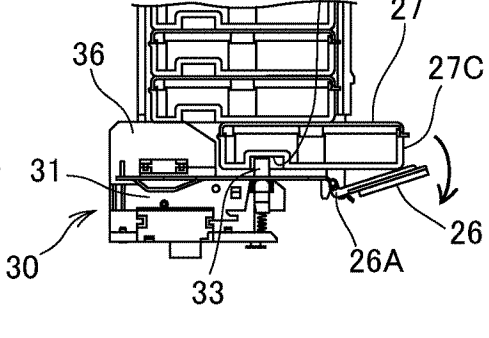

When the push-out mechanism 30 further moves forward, the pill case 27 on the lowermost tier is pushed out by the pill case support portion 36, as shown in FIG. 4E.

The pill case returning claw 33 does not function in the push-out action for the pill case 27. However, in the middle of the pill case support portion 36 pushing out the pill case 27 on the lowermost tier, the pill case returning claw 33 is fitted in the recessed portion 27A of the pill case 27, and therefore, even if the pill case 27 on the lowermost tier is to be pulled out to a back side, the pill case 27 cannot be pulled out.

When the pill case 27 is pushed out by the pill case support portion 36, the lid 26 provided at the cassette 25 is opened with a base portion 26A as a base point, and a front end 27C of the pill case 27 protrudes.

When the pill case 27 is pushed out, the lid 26 supports the pill case 27 from below, and therefore, the pill case 27 can be stopped there without falling off.

Figure 4F:
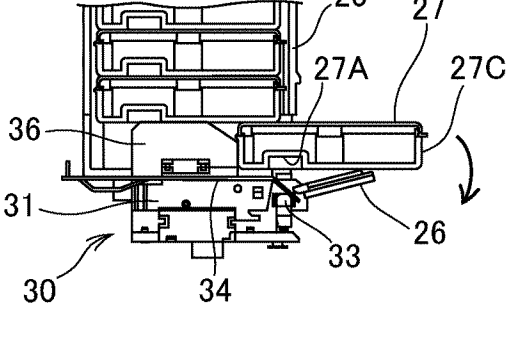

In a stroke limit of the push-out mechanism 30, the push-out block 31 pushes out the pill case 27 on the lowermost tier by a predetermined dimension, as shown in FIG. 4F. In this case, the pill case returning claw 33 lowers along a cam profile of the cam 34, and escapes from the recessed portion 27A of the pill case 27. The pill case returning claw 33 escapes from the recessed portion 27A, whereby, in a state in FIG. 4F, the front end 27C of the pill case 27 is held with a hand, and the pill case 27 can be extracted from the cassette 25.

In the embodiment, when the push-out mechanism 30 pushes out the pill case 27 on the lowermost tier by the predetermined dimension, the user takes hold of the front end 27C of the pill case 27 which is pushed out by using his or her hand, and can extract the pill case 27 from the medication-taking support device 1. The predetermined dimension is set at a dimension with which the front end 27C of the pill case 27 can be held by using a hand.

In the process of pushing out the pill case 27, the pill case support portion 36 supports the pill cases 27 on upper tiers, as shown in FIGS. 4E and F. Accordingly, in the process of pushing out the pill case 27 on the lowermost tier, the pill cases 27 on the upper tiers do not fall off.

In the embodiment, the tip end 36A of the pill case support portion 36 abuts on the rear end 27B of the pill case 27 and pushes out the pill case 27, and therefore, once the pill case 27 is pushed out, the pill case 27 is not pushed into the cassette 25, even if the user erroneously pushes the pill case 27 into the cassette 25.

Figures 5A, 5B, 5C, 5D, 5E, 5F, 5G, 5H:
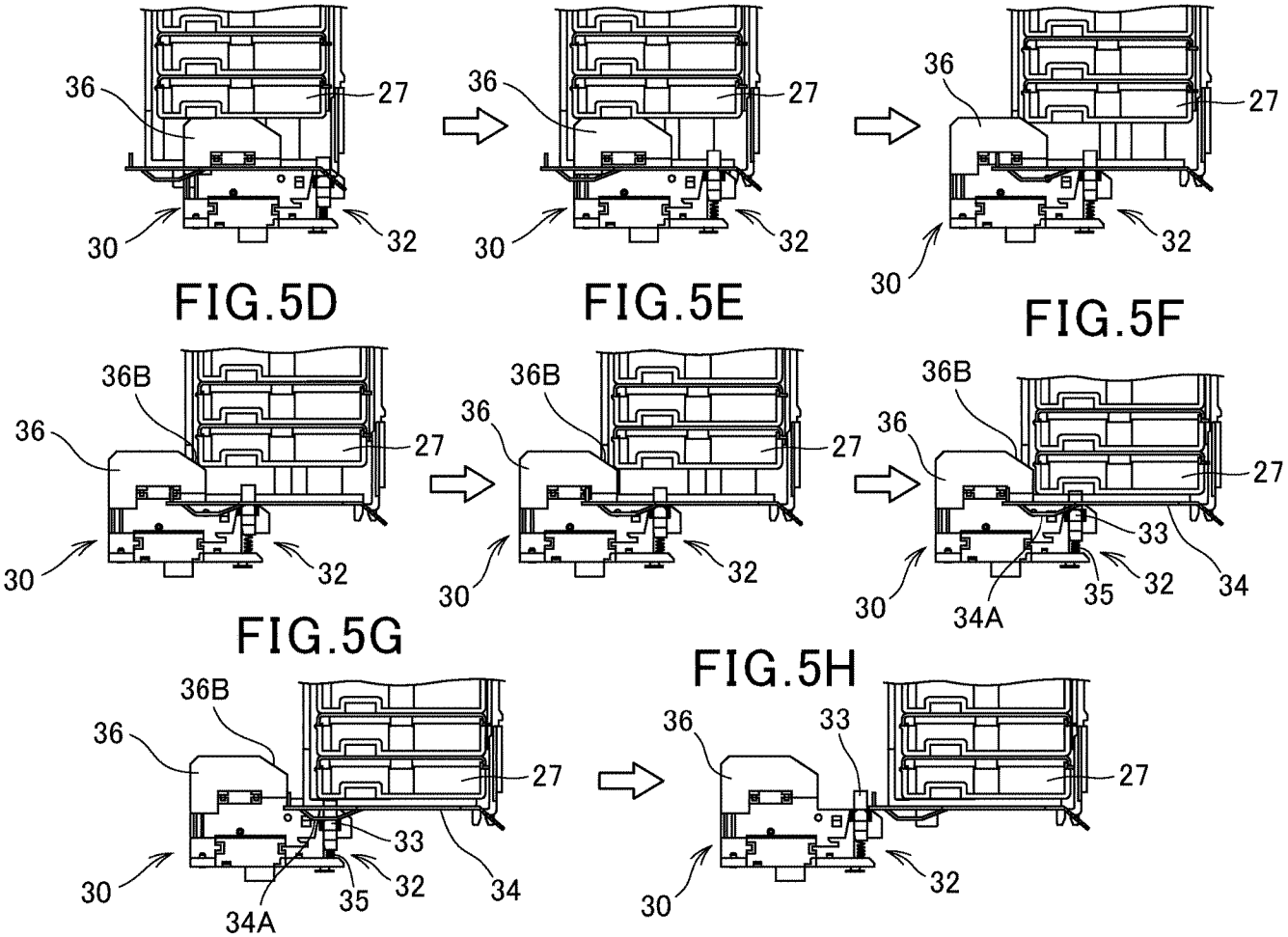
FIG. 5 A to H are views explaining a retreating action of the push-out mechanism.

FIG. 5A shows a state where the pill case 27 is extracted by the hand of the user. In this state, the pill case support portion 36 of the push-out mechanism 30 supports the pill cases 27 on the upper tiers. When the push-out mechanism 30 starts retreating from this state, the push-out mechanism 30 reaches states in FIGS. 5C to E through a state in FIG. 5B. In the states in FIGS. 5C to E, the pill case 27 on the upper tier slowly descends along a front end taper face 36B of the pill case support portion 36. Subsequently, in a state in FIG. 5F, the pill case 27 on the upper tier falls on the lowermost tier while keeping a parallel state.

In a process of FIGS. 5F and G, the pill case returning claw 33 lowers along the convex face 34A of the cam 34 against the spring force of the spring 35, and escapes from the recessed portion 27A of the pill case 27. Subsequently, the pill case returning claw 33 reaches the standby position in FIG. 5H.

FIG. 6 shows a process of pulling back the pill case 27 on the lowermost tier when the pill case 27 on the lowermost tier is not pulled out.

Figure 6A:
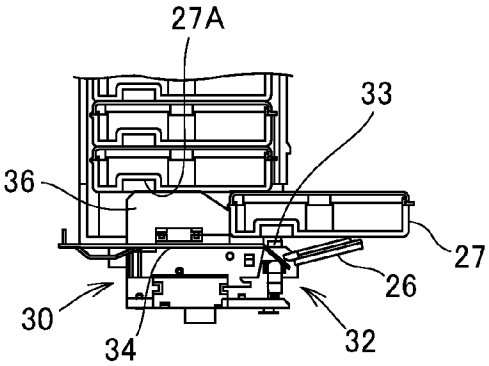
FIG. 6 A to F are views explaining a pull-back action by a pull-back mechanism.
Figure 6B:
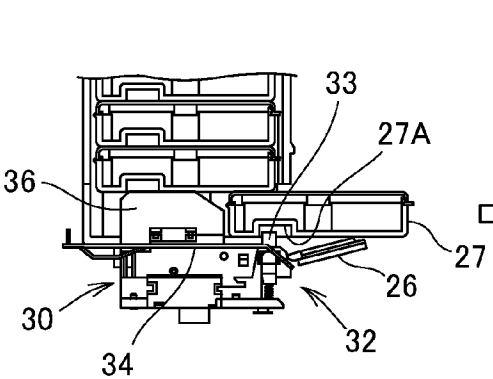

As shown in FIG. 6A, when the pill case 27 is not pulled out, if retreat of the push-out mechanism 30 is started, the pill case returning claw 33 rises along the cam face of the cam 34, and is fitted in the recessed portion 27A of the pill case 27, as shown in FIG. 6B.

Figure 6C:
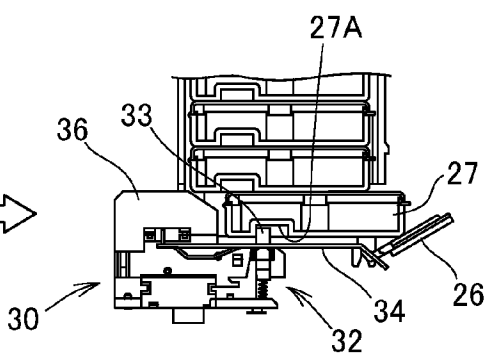
Figure 6D:
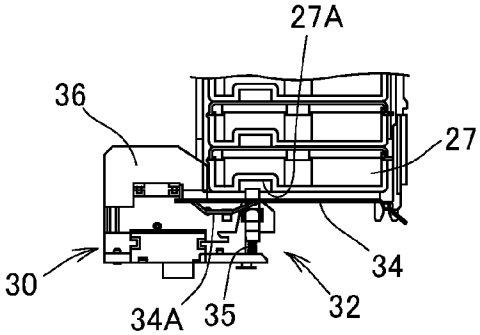
Figure 6E:
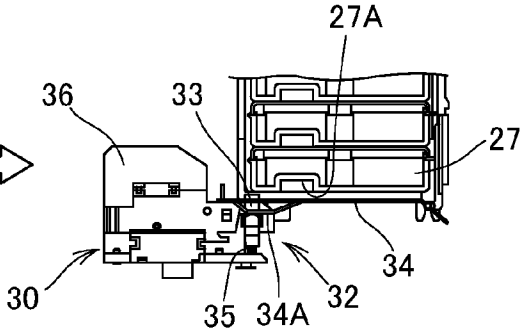
Figure 6F:
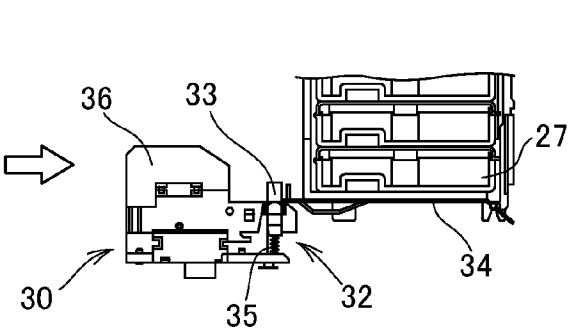

When retreat of the push-out mechanism 30 is continued in a state where the pill case returning claw 33 is fitted in the recessed portion 27A, the pill case returning claw 33 moves the pill case 27 to a back side of the cassette 25, as shown in FIGS. 6B to D.

In a process of FIGS. 6A to C, pull-back of the pill case 27 is smooth because the pill case support portion 36 supports the pill cases 27 on the upper tires.

In a process of FIGS. 6D and E, the pill case returning claw 33 lowers along the convex face 34A of the cam 34 against the spring force of the spring 35, and escapes from the recessed portion 27A of the pill case 27. Subsequently, the pill case returning claw 33 reaches the standby position in FIG. 6F.

Next, with reference to FIG. 3, a procedure of disposing the cassette 25 will be described.

However, in FIG. 3, at a time point of starting disposition of the cassette 25, the cassette 25 is assumed not to be disposed in the rotary basket 15.

First, the first cassette 25 is set on the rack 23D in the rotary basket 15, by opening the opening and closing lid 7 (refer to FIG. 1) on the top face of the cover 3. The opening and closing lid 7 is located directly above the rack 23D. When the opening and closing lid 7 on the top face of the cover 3 is opened, the push-out mechanism 30 moves forward to a cassette detection position (position in FIG. 4C) in accordance with a control flow of a control device not illustrated.

Figure 7:
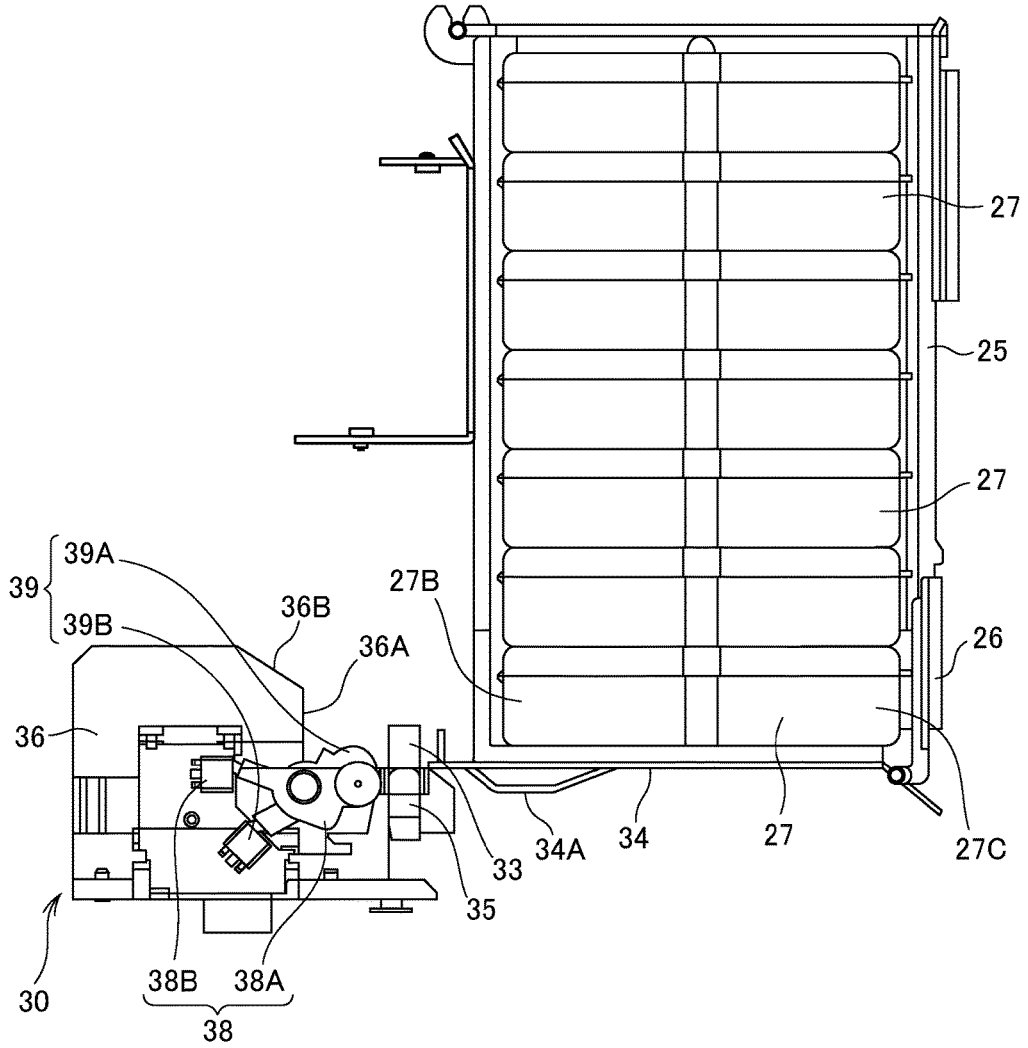
FIG. 7 is a view showing a cassette detecting sensor and a pill case detecting sensor.

As shown in FIG. 7, in the push-out block 31 of the push-out mechanism 30, a cassette detecting sensor 38 that detects presence of the cassette 25, and a pill case detecting sensor 39 that detects presence of the pill case 27 are disposed. The cassette detecting sensor 38 is configured to include a lever 38A and a detection section 38B, and the pill case detecting sensor 39 is configured to include a lever 39A and a detection section 39B. When the push-out mechanism 30 moves forward, and reaches the position in FIG. 4C, the sensors 38 and 39 advance under the rack 23, and detect the cassette 25 and the pill case 27.

When the cassette detecting sensor 38 is not provided, the cassette 25 cannot be detected, and therefore, when the pill case detecting sensor 39 does not detect the pill case 27, it cannot be determined whether a state is such that there is no pill case 27 in the cassette 25, or such that no cassette 25 is attached to the rack 23.

In the present embodiment, by providing the two sensors 38 and 39, an empty cassette where no pill case 27 is charged can be easily identified.

Further, in the present embodiment, the cassette detecting sensor 38 and the pill case detecting sensor 39 are provided in the push-out mechanism 30, whereby the two sensors 38 and 39 can be collectively disposed at one spot, and reduction in cost, simplification of wiring and the like can be achieved.

Next, the user inputs time data for ejecting the pill case 27 on the lowermost tier, which is stored in the cassette 25, from the pill case ejection port 5. Subsequently, the user presses a button (not illustrated) that rotates the rotary basket 15. When the button is pressed, the push-out mechanism 30 returns to the standby position from the cassette detection position under the condition that the presence of the cassette 25 and the pill case 27 is detected by the sensors 38 and 39, and thereafter, the rotary basket 15 rotates clockwise. When the next rack 23 reaches directly under the opening and closing lid 7, the rotary basket 15 stops. When the rotary basket 15 stops, the push-out mechanism 30 moves forward to the cassette detection position (position in FIG. 4C). When the next cassette 25 is attached to the next rack 23, the user inputs time data for ejecting the pill case 27 on the lowermost tier, which is stored in the next cassette 25 from the pill case ejection port 5. Subsequently, the user presses the button (not illustrated) that rotates the rotary basket 15. The operation is continued until attachment of the six cassettes 25 is completed.

Next, the double acting door 6 provided at the pill case ejection port 5 will be described.

As shown in FIG. 1, the double acting door 6 includes a left door 6L provided at a left side in front view, and a right door 6R provided at a right side in front view. The left door 6L and the right door 6R are rotatably supported with both side edges of an opening of the pill case ejection port 5 as center shafts 50L and 50R (FIG. 8). The center shafts 50L and 50R of rotation of the left door 6L and the right door 6R are provided with urging members that urge these doors in directions to close, and when no force is applied to these doors, the double acting door 6 is in a closed state.

In the following explanation, a state where the force that rotates these doors is not applied to the left door 6L and the right door 6R, and the double acting door 6 is closed will be referred to as "a closed state". Meanwhile, a state where the force that rotates these doors is applied to the left door 6L and the right door 6R, and the double acting door is opened even a little will be called "an open state".

FIG. 8 is a view showing the relation between the double acting door 6 and the pill case 27 when the pill case 27 is pushed out by the aforementioned push-out mechanism 30. FIG. 8 schematically expresses the respective members by simplifying the respective members with consideration given to convenience of explanation.

Figure 8A:
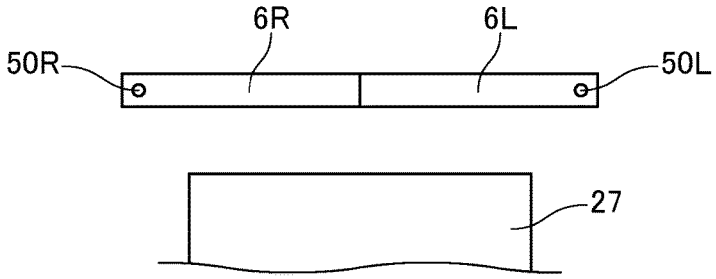
FIG. 8 is a view showing a relation between a door provided at an ejection port of the medication-taking support device, and a pill case.
Figure 8B:
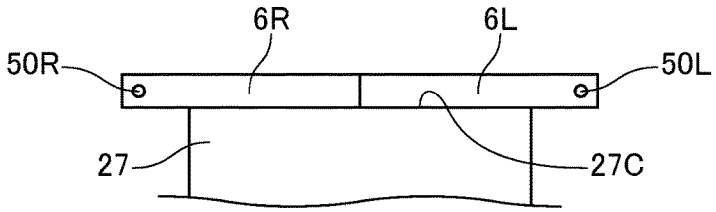

When the push-out mechanism 30 is located in the standby position, the pill case 27 and the double acting door 6 are separated, and the double acting door 6 is in a closed state, as shown in FIG. 8A.

Figure 8C:
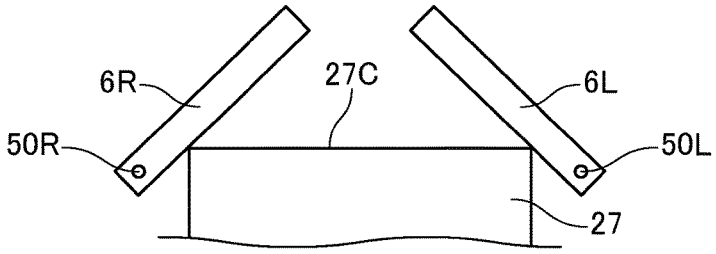

When the pill case 27 moves forward in accordance with push-out of the pill case 27 by the push-out mechanism 30, the front end 27C of the pill case 27 contacts a back side of the double acting door 6 (FIG. 8B), when the pill case 27 further moves forward, the front end 27C of the pill case 27 urges these doors to a front side while abutting on the left door 6L and the right door 6R. In response to urging by the front end 27C of the pill case 27, the left door 6L and the right door 6R rotate around the center shafts 50L and 50R, and the double acting door 6 gradually opens in accordance with rotation of these doors (FIG. 8C).

Figure 8D:
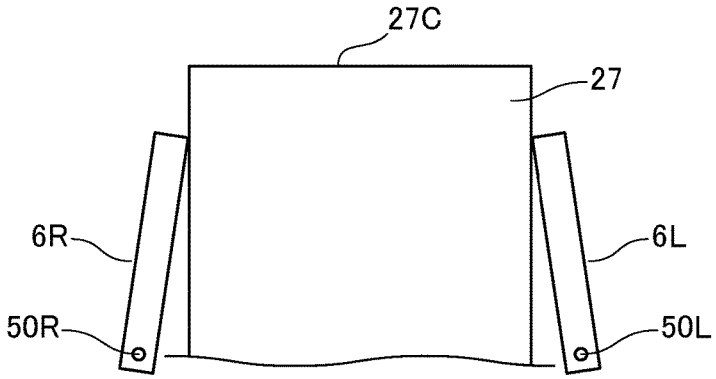

When the push-out mechanism 30 reaches a push-out completion position which is the position of the stroke limit, the front end 27C of the pill case 27 is in a state protruded beyond tip ends of the left door 6L and the right door 6R as shown in FIG. 8(D). In the state, the respective tip ends of the left door 6L and the right door 6R are locked to side faces of the pill case 27, and a state where the double acting door 6 is opened is kept. After the state is brought about, the user takes hold of the front end 27C of the pill case 27 with his or her hand, and can extract the pill case 27 from the cassette 25, as described above.

Figure 8E:
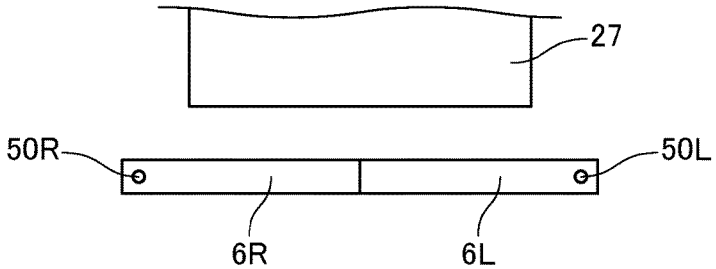

When the pill case 27 is extracted to outside of a casing of the medication-taking support device 1 by the user, the respective left door 6L and right door 6R are urged in the direction to close by the urging member not illustrated. As a result, the double acting door 6 is brought into a closed state as shown in FIG. 8E.

Incidentally, the medication-taking support device 1 has a function of recording a history of predetermined information on extraction of the pill case 27 by the user. Hereinafter, the function will be described in detail.

Figure 9:
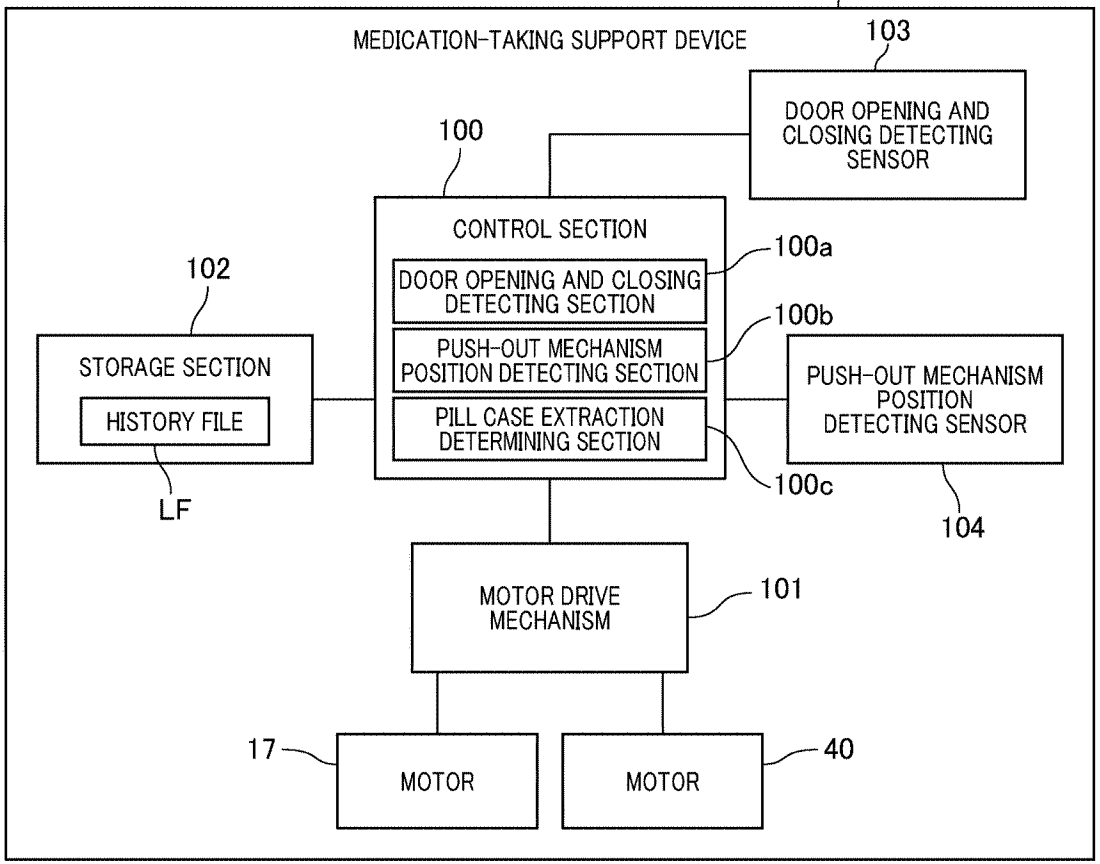
FIG. 9 is a block diagram showing a functional configuration of the medication-taking support device.

FIG. 9 is a block diagram showing a functional configuration of the medication-taking support device 1.

As shown in FIG. 9, the medication-taking support device 1 includes a control section 100, a motor drive circuit 101, a storage section 102, a door opening and closing detecting sensor 103 and a push-out mechanism position detecting sensor 104.

The control section 100 includes a CPU, a ROM, a RAM and other peripheral circuits. The control section 100 controls respective parts of the medication-taking support device 1 by reading and executing a control program that is installed in advance.

The control section 100 includes a door opening and closing detecting section 100*a*, a push-out mechanism position detecting section 100*b* and a pill case extraction determining section 100*c*, as functional blocks. Functions of the respective functional blocks are realized by cooperation of hardware and software by the CPU reading and executing predetermined control programs, and the like. The function, and processing of each of the functional blocks will be described later.

The motor drive circuit 101 includes a drive circuit such as a motor driver, outputs a drive current and a drive pulse to the motor 17 in accordance with control of the control section 100, and drives the motor 17. As described above, in accordance with drive of the motor 17, the rotary basket 15 is rotationally driven.

Further, the motor drive circuit 101 outputs a drive current and a drive pulse to the motor 40 in accordance with control of the control section 100, and drives the motor 40. As described above, the push-out mechanism 30 moves in a predetermined direction in accordance with drive of the motor 40.

The storage section 102 includes a nonvolatile memory, and stores various data to be rewritable. The storage section 102 stores a history file LF. The history file LF will be described later.

The door opening and closing detecting sensor 103 is a sensor that outputs a different signal to the control section 100 in accordance with whether the double acting door 6 is in a closed state or an open state. The door opening and closing detecting section 100*a* of the control section 100 detects whether the double acting door 6 is in the open state or the closed state, on the basis of an input from the door opening and closing detecting sensor 103.

The door opening and closing detecting sensor 103 may be an optical sensor that includes a light emitting portion and a light receiving portion, with a detection value of the light receiving portion changing in accordance with the state of the double acting door 6. Further, the door opening and closing detecting sensor 103 may be a mechanical sensor in which a state of a switch changes in accordance with the state of the double acting door 6, and an output changes in accordance with the state of the switch. That is, a mode of the door opening and closing detecting sensor 103 is not limited as long as the door opening and closing detecting sensor 103 is a sensor that can detect the state of the double acting door 6.

The push-out mechanism position detecting sensor 104 is a sensor that outputs a different signal to the control section 100, in accordance with whether the push-out mechanism 30 is located in the aforementioned standby position, is located in the aforementioned cassette detection position, or is located in a push-out completion position that is a position of the stroke limit. The push-out mechanism position detecting section 100*b* of the control section 100 detects that the push-out mechanism 30 is located in the standby position, is located in the cassette detection position, and is located in the push-out completion position, on the basis of input from the push-out mechanism position detecting sensor 104.

The push-out mechanism position detecting sensor 104 may be an optical sensor that includes a light emitting portion and a light receiving portion, with a detection value of the light receiving portion changing in accordance with the position of the push-out mechanism 30. Further, the push-out mechanism position detecting sensor 104 may be a mechanical sensor in which a state of a switch changes in accordance with the position of the push-out mechanism 30, and output changes in accordance with the state of the switch. That is, a mode of the push-out mechanism position detecting sensor 104 is not limited as long as the push-out mechanism position detecting sensor 104 is a sensor capable of detecting the position of the push-out mechanism 30.

Figure 10:
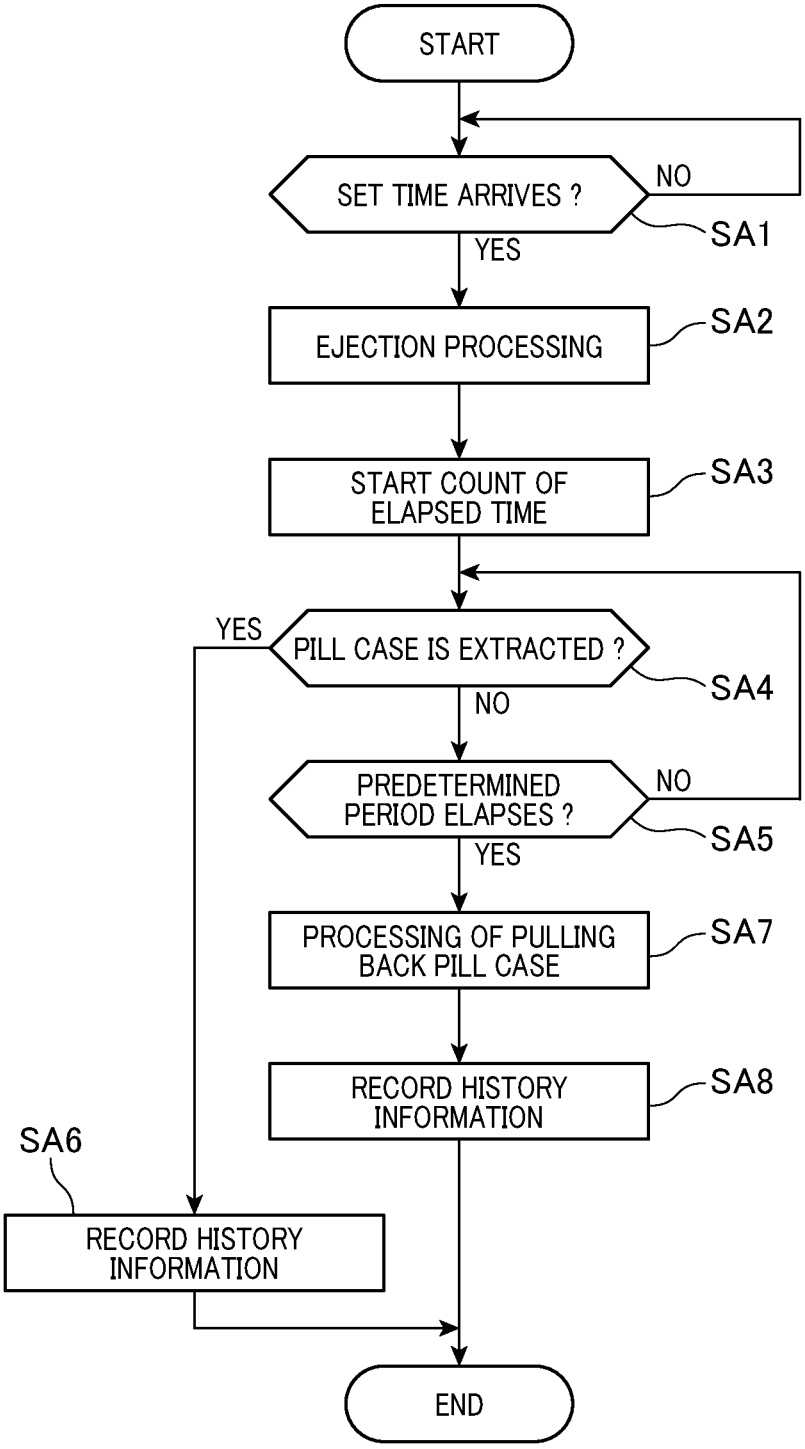
FIG. 10 is a flowchart showing an action of the medication-taking support device.

FIG. 10 is a flowchart showing an action of the medication-taking support device 1 concerning recording of a history.

Note that at a time point of start of the flowchart in FIG. 10, a state is such that by predetermined means, a time (hereinafter referred to as "a set time") to push out the pill case 27, and identification information of the cassette 25 storing the pill case 27 which is an object to be pushed out are set, and the set time and the identification information of the cassette 25 are recorded in a predetermined set file by being matched with each other. The identification information of the cassette 25 is information for use in identification of the cassette 25A to the cassette 25F, and identification information with a different value is assigned to each of the cassette 25A to the cassette 25F.

As shown in FIG. 10, the control section 100 of the medication-taking support device 1 monitors whether or not the set time arrives, on the basis of the information recorded in the set file (step SA1).

When the set time arrives (step SA1: YES), the control section 100 controls the motor drive circuit 101, drives the motor 17 and the motor 40, and executes processing (hereinafter, referred to as "ejection processing") of pushing out the pill case 27 stored in the predetermined cassette 25 (step SA2).

During execution of the ejection processing, the push-out mechanism 30 moves from the standby position through the cassette detection position to reach the push-out completion position. With movement of the push-out mechanism 30, the double acting door 6 shifts from the closed state to an open state.

When the push-out mechanism 30 reaches the push-out completion position by the ejection processing in step SA2, and brings about a state where extraction of the pill case 27 by the user is possible, the control section 100 starts count of an elapsed time (step SA3).

Next, the control section 100 monitors whether or not the pill case 27 is extracted by the user before a lapse of a predetermined period (step SA4) while monitoring whether or not a predetermined period set in advance elapses after starting count of the elapsed time (step SA5).

Hereinafter, processing in step SA4 will be described in detail.

In step SA4, the pill case extraction determining section 100*c* of the control section 100 detects whether or not the pill case 27 is extracted by the user by the following method.

That is, in step SA4, the pill case extraction determining section 100*c* monitors the position of the push-out mechanism 30 and the state of the double acting door 6 on the basis of the detection result of the door opening and closing detecting section 100*a* based on the input from the door opening and closing detecting sensor 103, and the detection result of the push-out mechanism position detecting section 100*b* based on the input from the push-out mechanism position detecting sensor 104. Subsequently, the pill case extraction determining section 100*c* determines that the extraction of the pill case 27 is not performed when the push-out mechanism 30 is in a state located in the push-out completion position, and the double acting door 6 is in an open state.

Meanwhile, the pill case extraction determining section 100*c* determines that extraction of the pill case 27 is performed, when the push-out mechanism 30 is in a state located in the push-out completion position, and the double acting door 6 is in a closed state. Here, as shown in FIG. 8(E), when extraction of the pill case 27 is performed, the double acting door 6 shifts to a closed state while the push-out mechanism 30 remains in the state reaching the push-out completion position. Consequently, the pill case extraction determining section 100*c* can detect that extraction of the pill case 27 is performed by the user by detecting that the push-out mechanism 30 is in the state located in the push-out completion position and the double acting door 6 is in a closed state.

As above, in the present embodiment, the pill case extraction determining section 100*c* detects presence or absence of extraction of the pill case 27 by using the fact that the pill case 27 is pushed out by movement of the push-out mechanism 30, and the state of the double acting door 6 changes with pushing-out of the pill case 27. Consequently, the pill case extraction determining section 100*c* can properly detect presence or absence of extraction of the pill case 27 by using the characteristic in the structure of the medication-taking support device 1, an exclusive mechanism for detecting presence or absence of extraction of the pill case 27 does not have to be provided in the medication-taking support device 1, and reduction in manufacture cost and size reduction can be realized.

When the pill case 27 is extracted before the predetermined period elapses after starting count of the elapsed time (step SA4: YES), the control section 100 records history information in the history file LF which the storage section 102 stores (step SA6).

The history information recorded in the history file LF in step SA6 is, for example, information indicating the time at which the pill case 27 is pushed out, information indicating that the pill case 27 is extracted, information indicating the time at which the pill case 27 is extracted, identification information of the cassette 25 from which the pill case 27 is extracted and the like. The information like this is recorded in the history file LF as the history information, whereby the user can obtain useful information on extraction of the pill case 27 by referring to the information recorded in the history file LF by predetermined means.

Meanwhile, when the predetermined period elapses after starting count of the elapsed time without the pill case 27 being extracted (step SA5: YES), the control section 100 controls the motor drive circuit 101, drives the motor 40, and executes processing of pulling back the pill case 27 to the cassette 25 (step SA7).

In accordance with pull-back of the pill case 27 to the cassette 25, the push-out mechanism 30 moves from the push-out completion position to the standby position, and the double acting door 6 shifts from the open state to a closed state. The pill case extraction determining section 100*c* of the control section 100 detects that extraction of the pill case 27 by the user is not performed by detecting that the double acting door 6 shifts from the open state to the closed state in accordance with movement of the push-out mechanism 30 from the push-out completion position to the standby position, on the basis of the detection result of the door opening and closing detecting section 100*a* based on the input from the door opening and closing detecting sensor 103, and the detection result of the push-out mechanism position detecting section 100*b* based on the input from the push-out mechanism position detecting sensor 104.

Next, the control section 100 records history information in the history file LF which the storage section 102 stores (step SA8).

The history information recorded in the history file LF in step SA8 is, for example, information indicating a time at which the pill case 27 is pushed out, information indicating that the pill case 27 is not extracted, identification information of the cassette 25 in which the pill case 27 pushed out is stored and the like. The information like this is recorded in the history file LF as the history information, whereby the user can obtain useful information concerning extraction of the pill case 27 by referring to the information recorded in the history file LF by predetermined means.

As described above, in the present embodiment, the six racks 23 are included on the rotary basket 15, and the six racks 23 are disposed on the concentric circle with the rotary shaft 11 as the center. Consequently, as compared with the structure in which the respective racks 23 are arranged laterally, size reduction can be achieved. Therefore, the medication-taking support device is handy to carry about, and does not take up a lot of space. Further, as compared with the structure in which the respective racks 23 are arranged laterally, the single push-out mechanism 30 only has to be disposed in the center of the racks 23, and the device configuration can be simplified.

In the present embodiment, the pull-back mechanism 32 is included, and therefore, even when the pill case 27 is not pulled out from the cassette 25 at a predetermined time, the pill case 27 is returned to the cassette 25 by the pull-back mechanism 32.

Accordingly, when the pill case 27 is not received by the user, the pill case 27 is not left outside the cassette 25, and accidental ingestion can be prevented.

Further, the medication-taking support device 1 according to the present embodiment includes the door opening and closing detecting section 100*a* which detects opening and closing of the double acting door 6 (the door portion) provided at the pill case ejection port 5 (ejection port), the push-out mechanism position detecting section 100*b* which detects the action position of the push-out mechanism 30, the pill case extraction determining section 100*c* which determines whether or not the pill case 27 is extracted based on the detection results of the door opening and closing detecting section 100*a* and the push-out mechanism position detecting section 100*b*, and the storage section 102 which stores the determination result by the pill case extraction determining section 100*c*.

According to the configuration, in the medication-taking support device 1, whether or not the pill case 27 is extracted can be properly determined on the basis of the detection results of the door opening and closing detecting section 100*a* and the push-out mechanism position detecting section 100*b*, the detection result is stored, and therefore useful information on extraction of the pill case 27 can be obtained on the basis of the stored information.

Further, the pill case extraction determining section 100*c* of the medication-taking support device 1 according to the present embodiment determines whether or not the pill case 27 is extracted, when the door opening and closing detecting section 100*a* detects that the double acting door 6 is closed.

According to the configuration, the medication-taking support device 1 can determine whether or not the pill case 27 is extracted at the timing at which the double acting door 6 is closed by using the state of the double acting door 6 changing in accordance with presence or absence of extraction of the pill case 27.

Further, the pill case extraction determining section 100*c* of the medication-taking support device 1 according to the present embodiment determines that the pill case 27 is extracted, when the push-out mechanism 30 is determined as being located in the push-out completion position when the double acting door 6 is closed, and determines that the pill case 27 is not extracted when the push-out mechanism 30 is determined as being not located in the push-out completion position when the double acting door 6 is closed.

According to the configuration, the medication-taking support device 1 can properly detect presence or absence of extraction of the pill case 27 by using the characteristic in the structure of the device, an exclusive mechanism for detecting presence or absence of extraction of the pill case 27 does not have to be provided in the device, and reduction in manufacture cost, and size reduction can be realized.

Modification Example

Next, a modification example will be described.

Figure 11:
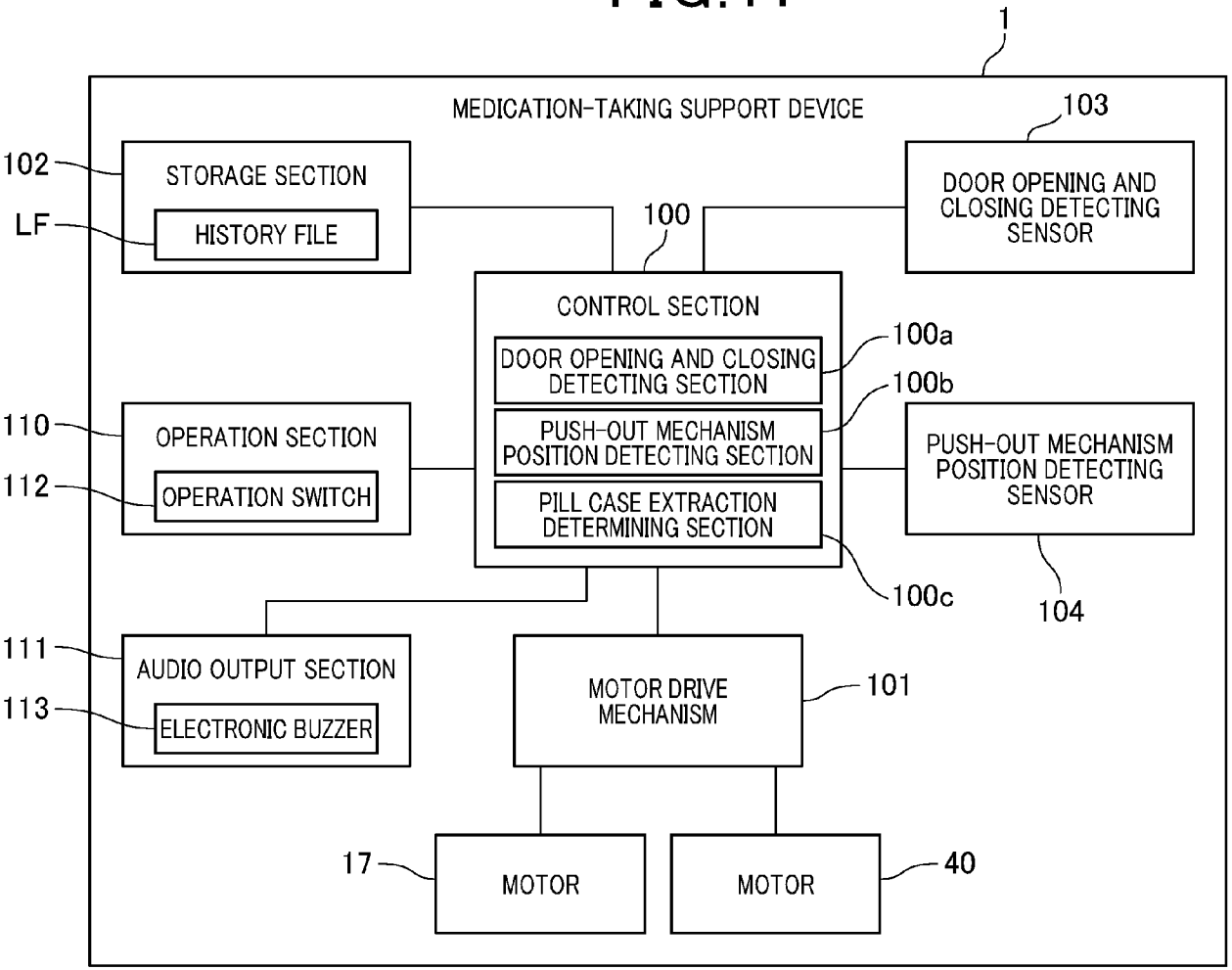
FIG. 11 is a block diagram showing a functional configuration of the medication-taking support device according to a modification example.

FIG. 11 is a block diagram showing a functional configuration of the medication-taking support device 1 according to the modification example.

Hereinafter, with respect to the functional configuration of the medication-taking support device 1 according to the modification example, the same functional components as the functional components in the medication-taking support device 1 according to the aforementioned embodiment are assigned with the same reference signs, and explanation thereof will be omitted.

As is obvious from comparison of FIG. 11 and FIG. 9, the medication-taking support device 1 according to the modification example includes an operation section 110 and an audio output section 111.

The operation section 110 includes an operation switch 112 (a pill case extraction button) that is operated when the user ejects the pill case 7 from the medication-taking support device 1. The operation section 110 detects an operation to the operation switch 112, and outputs the operation to the control section 100.

The audio output section 111 outputs an electronic buzzer 112. The audio output section 111 drives the electronic buzzer 112 to output predetermined electronic sound by control of the control section 100.

Figure 12:
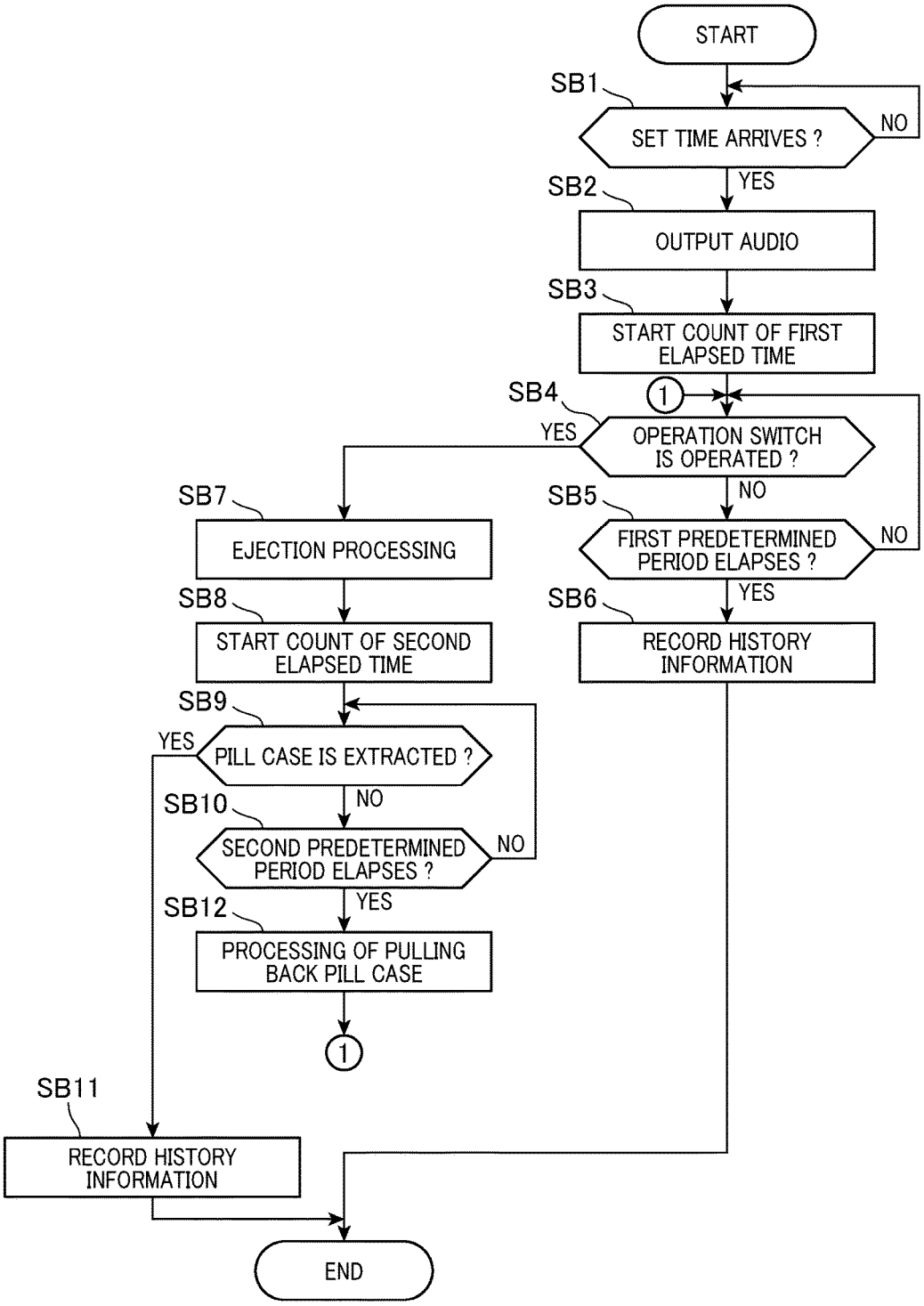
FIG. 12 is a flowchart showing an action of the medication-taking support device according to the modification example.

FIG. 12 is a flowchart showing an action of the medication-taking support device 1 according to the modification example.

Note that at a time point of start of the flowchart in FIG. 12, a state is such that a set time and identification information of the cassette 25 in which the pill case 27 which is an object to be pushed out is stored are set, and the set time and the identification information of the cassette 25 are stored in a predetermined set file by being matched with each other.

As shown in FIG. 12, the control section 100 of the medication-taking support device 1 monitors whether or not the set time arrives on the basis of the information recorded in the set file (step SB1).

When the set time arrives (step SB1: YES), the control section 100 controls the audio output section 111, outputs electronic sound by the electronic buzzer 112 as sound to notify the user that the set time has arrived (step SB2).

Next, the control section 100 starts count of a first elapsed time (step SB3).

Next, the pill case extraction determining section 100*c* of the control section 100 monitors whether or not the operation switch 112 is operated by the user before a lapse of a first predetermined period (step SB4), while monitoring whether or not the first predetermined period set in advance has elapsed after count of the first elapsed time is started (step SB5).

The first predetermined period is a period in which the user can operate the operation switch 112 included in the medication-taking support device 1. For example, the first predetermined period is one hour from "12:00" to "13:00" when the set time is "12:00". The user can acquire the medicine stored in the pill case 27 by operating the operation switch 112 at an arbitrary timing before the first predetermined period elapses, and causing the pill case 27 to be ejected.

When the first predetermined period elapses after count of the first elapsed time is started, without the operation switch 112 being operated (step SB5: YES), the pill case extraction determining section 100*c* records the history information in the history file LF which the storage section 102 stores (step SB6).

The history information recorded in the history file LF in step SB6 is, for example, information indicating the time at which the output of the electronic sound is started, information indicating that the pill case 27 is not extracted, identification information of the cassette 25 in which the pill case 27 which is pushed out is stored and the like. The information like this is recorded in the history file LF as the history information, whereby the user can obtain useful information on extraction of the pill case 27, by referring to the information recorded in the history file LF by predetermined means.

The processing in steps SB4, SB5 and SB6 corresponds to the processing of the pill case extraction determining section 100*c* determining that the pill case 27 is not extracted, and storing the determination result in the storage section 102, when determining that the operation switch 112 (the pill case extraction button) is not operated within the predetermined time period set advance, in which the pill case 27 can be ejected.

Meanwhile, when the pill case 27 is extracted before the first predetermined period elapses after count of the first elapsed time is started (step SB4: YES), the control section 100 executes the aforementioned ejection processing (step SB7).

During execution of the ejection processing, the push-out mechanism 30 moves from the standby position through the cassette detection position to reach the push-out completion position. With movement of the push-out mechanism 30, the double acting door 6 shifts from the closed state to an open state.

When the push-out mechanism 30 reaches the push-out completion position by the ejection processing in step SB7, and is brought into a state where extraction of the pill case 27 by the user is possible, the control section 100 starts count of a second elapsed time (step SB8).

Next, the control section 100 monitors whether or not the pill case 27 is extracted by the user before a lapse of a second predetermined period (step SB9), while monitoring whether or not the second predetermined period set in advance elapses after count of the second elapsed time is started (step SB10).

The second predetermined period is a period in which the user operates the operation switch 112 included in the medication-taking support device 1 within the aforementioned first predetermined period to cause the predetermined pill case 27 to be ejected, and the user can extract the pill case 27.

For example, when the second predetermined period is set as one minute by the user, the control section 100 executes processing of pulling back the pill case 27, when one minutes elapses without the user extracting the pill case 27 after the pill case 27 is in an extractable state. In this way, by pulling back the pill case 27 when the second predetermined period elapses without the user extracting the pill case 27 after the pill case 27 is in the extractable state, the pill case 27 can be prevented from being left for a long time in an extractable state, and a third person except for the user can be prevented from erroneously extracting the pill case 27.

In step SB9, the pill case extraction determining section 100*c* of the control section 100 executes determination of whether or not the pill case 27 is extracted by the similar method to the method in the aforementioned embodiment. Thereby, as described in the aforementioned embodiment, the pill case extraction determining section 100*c* can properly detect presence or absence of extraction of the pill case 27 by using the characteristic in the structure of the medication-taking support device 1, an exclusive mechanism for detecting presence and absence of extraction of the pill case 27 does not have to be provided in the medication-taking support device 1, reduction in manufacture cost, and size reduction can be realized.

When the pill case 27 is extracted before the predetermined period elapses after starting count of the elapsed time (step SB9: YES), the control section 100 records history information in the history file LF which the storage section 102 stores (step SB11).

The history information recorded in the history file LF in step SB11 is, for example, information indicating the time at which audio output of the electronic sound is started, information indicating the time at which the pill case 27 is pushed out, information indicating that the pill case 27 is extracted, information indicating the time at which the pill case 27 is extracted, identification information of the cassette 25 from which the pill case 27 is extracted and the like. The information like this is recorded in the history file LF as the history information, whereby the user can obtain useful information on extraction of the pill case 27 by referring to the information recorded in the history file LF by predetermined means.

Meanwhile, when the second predetermined period elapses after starting count of the second elapsed time without the pill case 27 being extracted (step SB10: YES), the control section 100 controls the motor drive circuit 101, drives the motor 40, and executes processing of pulling back the pill case 27 to the cassette 25 (step SB12).

In accordance with pull-back of the pill case 27 to the cassette 25, the push-out mechanism 30 moves from the push-out completion position to the standby position, and the double acting door 6 shifts from the open state to a closed state. The pill case extraction determining section 100*c* of the control section 100 detects that extraction of the pill case 27 by the user is not performed by detecting that the double acting door 6 shifts from the open state to the closed state in accordance with movement of the push-out mechanism 30 from the push-out completion position to the standby position, on the basis of the detection result of the door opening and closing detecting section 100*a* based on the input from the door opening and closing detecting sensor 103, and the detection result of the push-out mechanism position detecting section 100*b* based on the input from the push-out mechanism position detecting sensor 104.

After pulling the pill case 27 back to the cassette 25, the control section 100 returns the processing procedure to step SB4, monitors whether or not the first predetermined period has elapsed, and monitors whether or not the operation switch 112 is operated before the lapse of the first predetermined period, again.

Note that in the modification example, the user is notified that the set time arrives by the audio output, but notification to the user may be performed by display by predetermined display means, or vibration, for example.

Although the present invention is described on the basis of one embodiment thus far, the present invention is not limited to the embodiment.

For example, the configuration in which the pill case returning claw 33 is fitted in the recessed portion 27A in the bottom portion of the pill case 27, and the pill case 27 is pulled back, in the pull-back mechanism 32 is described, but the pull-back mechanism 32 is not limited to the embodiment. For example, the recessed portion 27A may be formed in the side surface of the pill case 27, without being limited to the bottom portion of the pill case 27.

The mechanism which drives the push-out mechanism 30 is described as the motor and the gear train, but the mechanism is not limited to this, and a drive method by a linear motor or the like, for example, is also applicable.

The push-out mechanism 30 and the pull-back mechanism 32 are integrated, but the push-out mechanism 30 and the pull-back mechanism 32 may be separated to be different bodies, without being limited to this.

Further, although in the aforementioned embodiment and the modification example of the embodiment, the history information recorded in the history file LF is illustrated, the history information is not limited to the illustrated one. For example, information indicating a time at which the cassette 25 is replaced may be recorded in the history file LF as the history information, and after a configuration is adopted, in which the user extracts the pill case 27 at an arbitrary timing by the user performing the predetermined operation, information indicating a time at which the user performs a predetermined operation, and information indicating a time at which the user extracts the pill case 27 may be recorded in the history file LF as the history information.

Further, as for the history information recorded in the history file LF in the aforementioned embodiment and the modification example of the embodiment, the history information may be enabled to be outputted to an outside such as a USB memory, a storage medium such as an SD card, and terminals such as a PC, a server or the like, via an externally outputting interface by providing the externally outputting interface in the medication-taking support device 1. Further, concerning output of the history information to the outside, wireless communication means is provided in the medication-taking support device 1, and the history information may be enabled to be outputted to external PCs, servers, other devices, storage media and the like by the wireless communication means by wireless communication.

Further, a slot in which a storage medium such as an SD card is provided in the medication-taking support device 1, and the history information may be enabled to be recorded in the recording medium set in the slot.

Further, in the aforementioned embodiment, and the modification example of the embodiment, the control section 100 detects whether or not extraction of the pill case 27 is performed on the basis of the position of the push-out mechanism 30, and the state of the double acting door 6. However, the present invention is not limited to this configuration, but may adopt a configuration in which a sensor that detects a state (an open state/a closed state) of the lid 26 is provided, and the control section 100 detects whether or not extraction of the pill case 27 is performed on the basis of the position of the push-out mechanism 30, and the state of the lid 26 based on the input from the sensor. With this configuration, presence or absence of extraction of the pill case 27 can be properly detected by using the characteristic in the structure of the medication-taking support device 1, an exclusive mechanism for detecting presence or absence of extraction of the pill case 27 does not have to be provided in the medication-taking support device 1, and reduction in manufacture cost, and size reduction can be realized.

Further, in the aforementioned embodiment, and the modification of the embodiment, the double acting door 6 which is brought into an open state by double acting is provided in the pill case ejection port 5 of the medication-taking support device 1. However, the member which closes the pill case ejection port 5 to be openable and closable is not limited to the double acting door 6, and a shape and a structure of opening and closing may be any shape and structure.

REFERENCE SIGNS LIST

1 Medication-taking support device
3 Cover
5 Pill case ejection port (ejection port)
6 Double acting door (door portion)
7 Opening and closing lid
11 Rotary shaft
15 Rotary basket
23 (23A to 23F) Rack
25 (25A to 25F) Cassette
27 Pill case
27A Recessed portion
30 Push-out mechanism
31 Push-out block
32 Pull-back mechanism
33 Pill case returning claw (pull-back member)
34 Cam (cam member)
36 Pill case support portion
112 Operation switch (pill case extraction button)

The invention claimed is:

1. A medication-taking support device, comprising:

a cassette that stores medicine-containing pill cases in a manner that the pill cases are stacked on top of one another;

a rack that has an opening, and the cassette being mounted from the opening;

a push-out mechanism that is configured to push out the pill case on a lowermost tier in the cassette by moving from a standby position to a push-out completion position; and a pull-back mechanism that pulls back the pill case remaining on the lowermost tier without being extracted from the cassette into the cassette, wherein the pull-back mechanism includes a pull-back member and a plate-shaped cam member, the pull-back member is urged upward by a spring and is fitted in a recessed portion of the pill case, and the plate-shaped cam member is disposed on an undersurface of the rack, and the pull-back member lowers along a cam profile of the plate-shaped cam member by pressing the spring, so that the pull-back member is made escapable from the recessed portion of the pill case, when the push-out mechanism pushes out the pill case by moving from the standby position to the push-out completion position.

2. The medication-taking support device according to claim 1, wherein the pull-back mechanism acts at a time of a retreating action of the push-out mechanism.

3. The medication-taking support device according to claim 2, further comprising: a door opening and closing detecting section that detects opening and closing of a door portion provided at an ejection port;

a push-out mechanism position detecting section that detects an action position of the push-out mechanism;

a pill case extraction determining section that determines whether or not the pill case is extracted on the basis of detection results of the door opening and closing detecting section and the push-out mechanism position detecting section; and a storage section that stores a determination result by the pill case extraction determining section.

4. The medication-taking support device according to claim 3, wherein the pill case extraction determining section determines whether or not the pill case is extracted, when the door opening and closing detecting section detects that the door portion is closed.

5. The medication-taking support device according to claim 3, wherein the pill case extraction determining section determines that the pill case is extracted, when the push-out mechanism is determined as being located in the push-out completion position when the door portion is closed, and determines that the pill case is not extracted, when the push-out mechanism is determined as being not located in the push-out completion position when the door portion is closed.

6. The medication-taking support device according to claim 2, further comprising:

a pill case extraction button that causes the pill case to be ejected;

a pill case extraction determining section that determines whether or not the pill case is extracted; and a storage section that stores a determination result by the pill case extraction determining section, wherein the pill case extraction determining section determines that the pill case is not extracted, and stores the determination result in the storage section, when determining that the pill case extraction button is not operated within a predetermined time period set in advance, in which the pill case can be ejected.

7. The medication-taking support device according to claim 1, wherein the pull-back mechanism is integrated with the push-out mechanism.

8. The medication-taking support device according to claim 1, wherein the push-out mechanism is provided with a cassette detecting sensor and a pill case detecting sensor.

9. The medication-taking support device according to claim 1, wherein a protrusion is provided on a side face of the cassette, and a groove in which the protrusion is fitted is provided at a corresponding pill case and a location of the protrusion differs according to the cassette, and a location of the groove differs according to the corresponding pill case so as to prevent erroneous disposition.

* * * * *